US007926654B2

(12) United States Patent
Dai et al.

(10) Patent No.: US 7,926,654 B2
(45) Date of Patent: Apr. 19, 2011

(54) PROTECTION CASE FOR ACCOMMODATING ELECTRONIC DEVICE

(75) Inventors: Lung Dai, Taipei Hsien (TW); Zhi-Peng Ma, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 97 days.

(21) Appl. No.: 12/477,111

(22) Filed: Jun. 2, 2009

(65) Prior Publication Data

US 2009/0308511 A1 Dec. 17, 2009

(51) Int. Cl.
*B65D 85/38* (2006.01)

(52) U.S. Cl. ..... 206/316.2; 206/320

(58) Field of Classification Search ..... 206/305, 206/320, 521, 316.1, 316.2, 564, 701, 722, 206/723; 150/130, 165; 190/127
See application file for complete search history.

(56) References Cited

U.S. PATENT DOCUMENTS

| | | | | |
|---|---|---|---|---|
| 5,195,634 | A * | 3/1993 | Zaug | 206/320 |
| 6,286,667 | B1 * | 9/2001 | Lee | 206/320 |
| 6,347,796 | B1 * | 2/2002 | Grossman et al. | 206/320 |
| 6,525,268 | B1 * | 2/2003 | Sellers | 206/701 |
| 7,594,576 | B2 * | 9/2009 | Chen et al. | 206/320 |
| 2006/0113203 | A1 * | 6/2006 | Daley | 206/320 |
| 2009/0107877 | A1 * | 4/2009 | Daley, III | 206/320 |

* cited by examiner

*Primary Examiner* — Luan K Bui
(74) *Attorney, Agent, or Firm* — Frank R. Niranjan

(57) ABSTRACT

A protection case for accommodating an electronic device with a display screen includes a soft encasing and a rigid protection plate. The soft encasing defines a receiving space for receiving the electronic device, and includes a side wall. The rigid protection plate is attached to an inner surface of the side wall. The protection plate includes a first surface facing the inner surface of the side wall and a second surface facing the receiving space of the soft encasing. The protection plate defines a recess on the second surface thereof corresponding to the display screen of the electronic device.

17 Claims, 3 Drawing Sheets

PROTECTION CASE FOR ACCOMMODATING ELECTRONIC DEVICE

BACKGROUND

1. Technical Field

The present invention relates to protection cases, and more particularly, to a protection case for accommodating an electronic device with a display screen.

2. Description of Related Art

Usually, a portable electronic device, such as a digital still camera, a mobile phone, etc., is accommodated in a protection case when the portable electronic device is not in use. The portable electronic device usually includes a display screen which is easy to be damaged. However, as the protection case is usually made of soft material, such as leather, textile, when the protection case is pressed by outside force, the protection case will be deformed and the outside force may be applied to the display screen of the portable electronic device directly. Therefore, the display screen cannot be protect effectively and may be damaged easily.

What is needed, therefore, is a protection case for accommodating an electronic device which can protect a display screen of the electronic device effectively to overcome or mitigate the above-described shortcomings is desired.

BRIEF DESCRIPTION OF THE DRAWINGS

Many aspects of the present protection case for accommodating electronic device can be better understood with reference to the accompanying drawings. The components in the drawings are not necessarily drawn to scale, the emphasis instead being placed upon clearly illustrating the principles of the present protection case for accommodating electronic device.

DETAILED DESCRIPTION

Embodiments of the present disclosure will now be described in detail below, with reference to the accompanying drawings.

Figure 1:
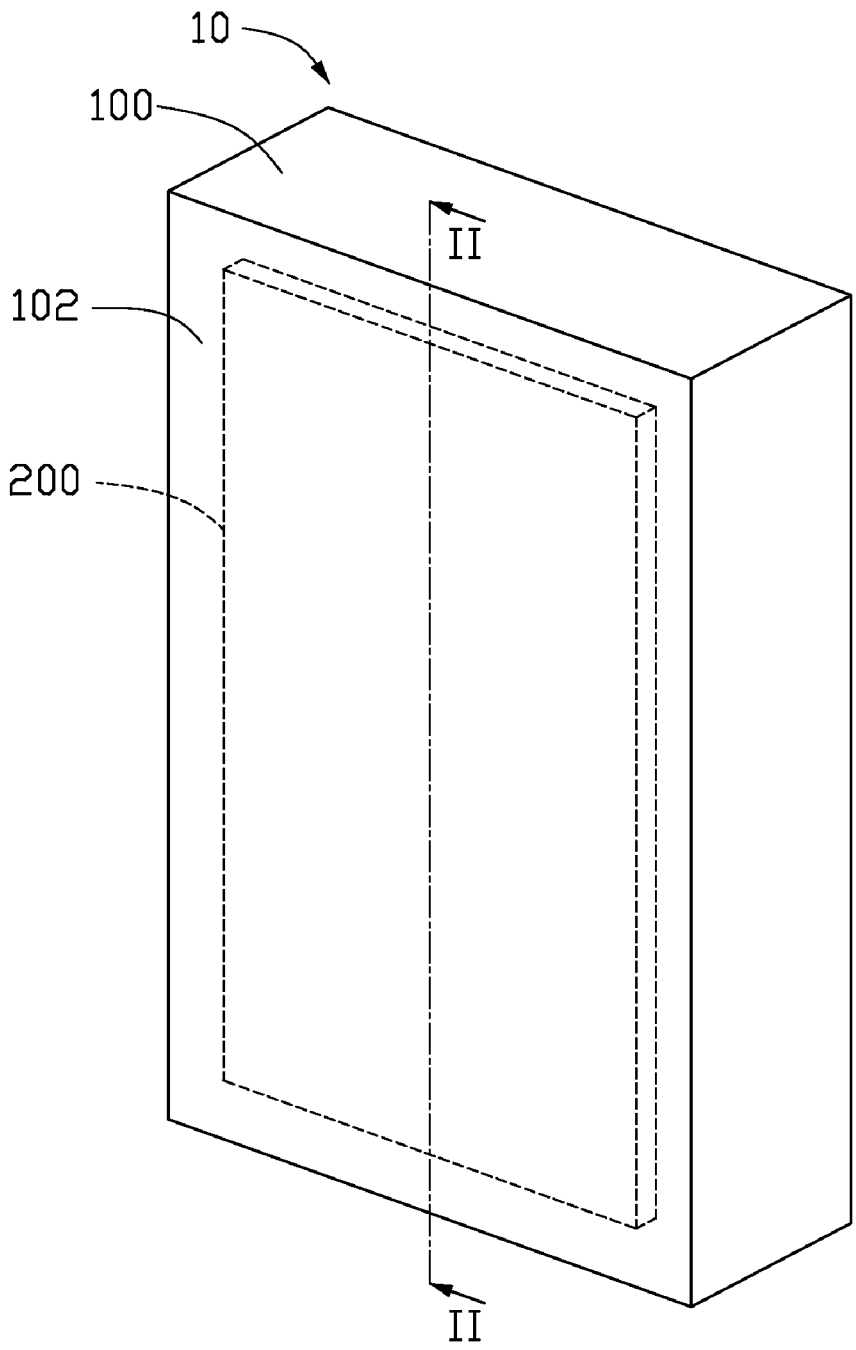
FIG. 1 is a schematic view of a protection case for accommodating an electronic device according to an exemplary embodiment.
Figure 2:
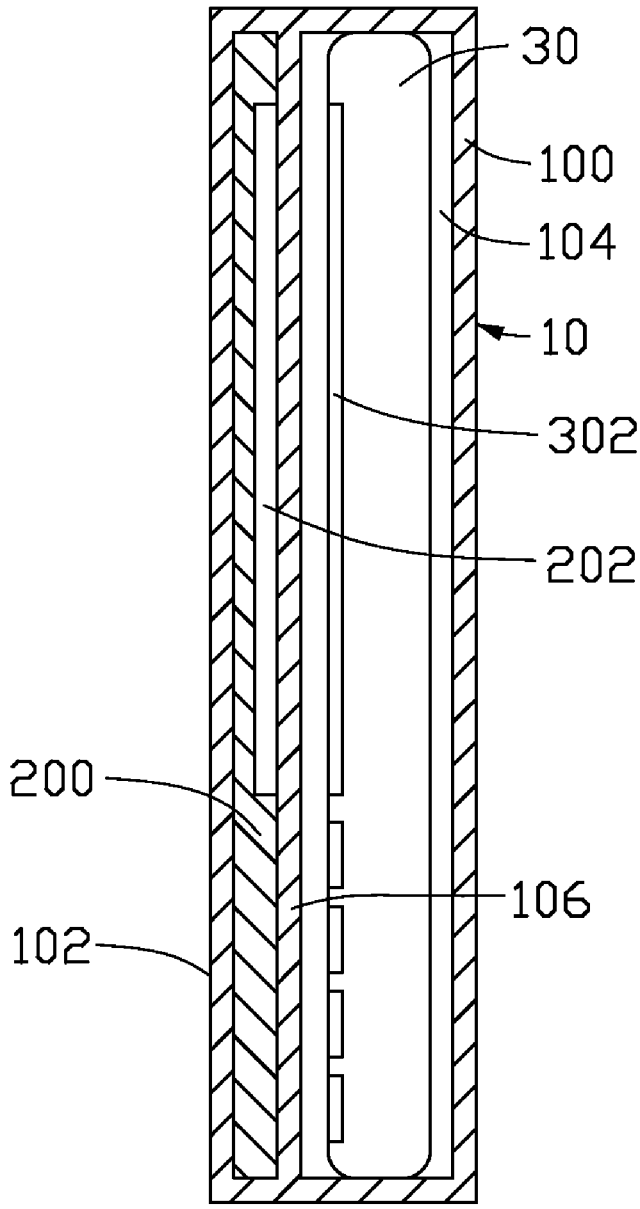
FIG. 2 is a cross sectional view of the protection case taken along line II-II of FIG. 1.

Referring to FIG. 1 and FIG. 2, a protection case 10 for accommodating an electronic device 30, according to a first exemplary embodiment, is shown. The protection case 10 includes a soft encasing 100 and a protection plate 200. The electronic device 30 can be a mobile phone, a digital camera etc. The electronic device 30 includes a display screen 302.

The soft encasing 100 is substantially cuboid, and defines a receiving space 104 for receiving the electronic device 30. The soft encasing 100 is made of soft material, such as leather, textile, rubber etc. The soft encasing 100 includes a side wall 102.

Figure 3:
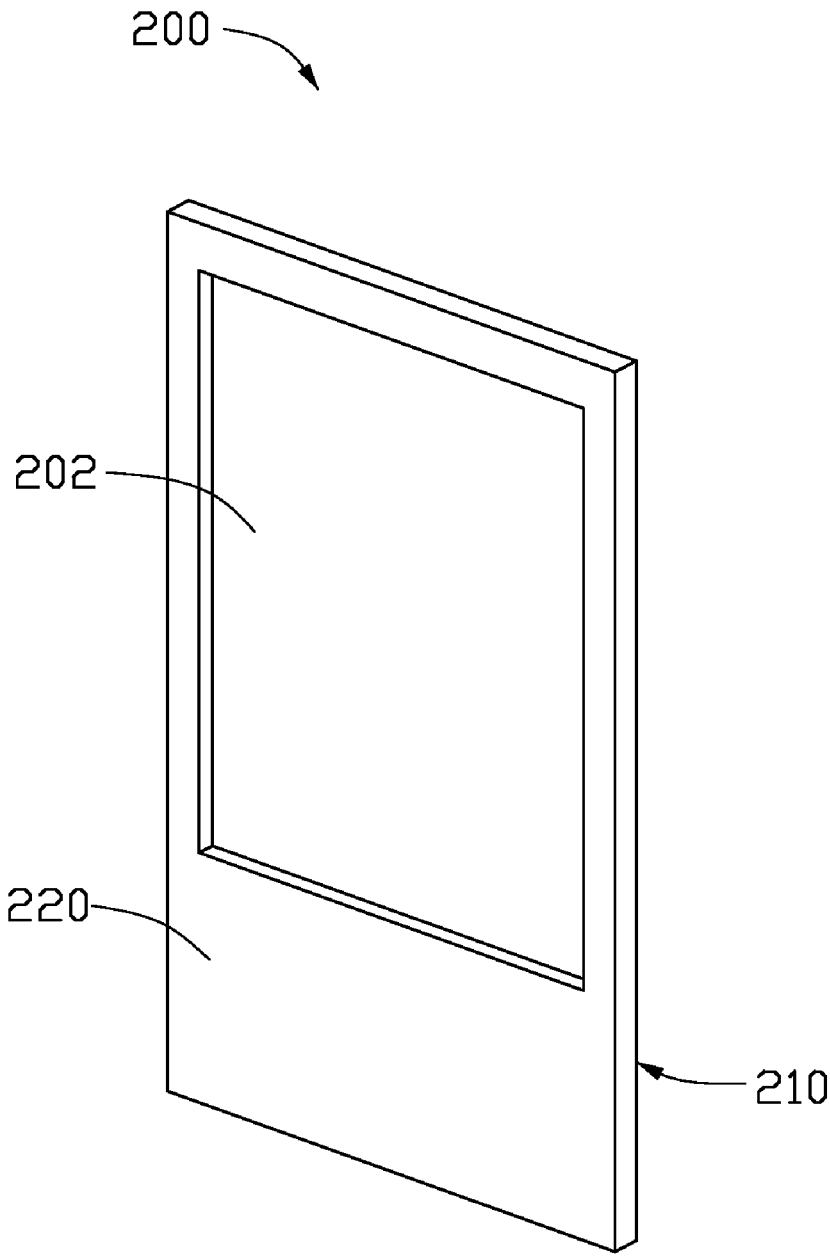
FIG. 3 is a schematic view of a protecting plate of the protection case of FIG. 1.

The protection plate 200 is attached to the inner surface of the side wall 102. The protection plate 200 is rigid. The protection plate 200 can be made of metal, plastic and so on. Further referring to FIG. 3, the protection plate 200 includes a first surface 210 and a second surface 220 opposite to the first surface 210. The first surface 210 faces an inner surface of the side wall 102, and the second surface 220 faces the receiving space 104 of the soft encasing 100. The protection plate 200 defines a recess 202 in the second surface 220. The shape of the recess 202 is substantially the same as that of the display screen 302 of the electronic device 30. The size of the recess 202 is equal to or larger than that of the display screen 302 of the electronic device 30. The size of the recess 202 is smaller than that of the electronic device 30. In the present embodiment, the shape of the recess 202 and the shape of the display screen 302 are rectangular.

When the electronic device 30 is received in the receiving space 104 of the soft encasing 100, the display screen 302 of the electronic device 30 faces the recess 202 of the protection plate 200. The protection plate 200 is rigid, so as to protect the display screen 302 of the electronic device 30 from impacts and so on. Furthermore, because the protection plate 200 defines the recess 202 on the second surface 220 facing the display screen 302, the display screen 302 of the electronic device 30 cannot be chafed by the protection plate 200, and even if the protection plate 200 deforms slightly by impact, the protection plate 200 does not exerts a damaging force on the display screen 302.

In the present embodiment, the soft encasing 100 further includes an interlayer 106 covering the second surface 220 of the protection plate 200. The interlayer 106 is made of soft material, such as leather, textile, rubber etc. Because the interlayer 106 covers the second surface 220 of the protection plate 200, the protection plate 200 would not contact with the electronic device 30 directly, therefore, this prevents the electronic device 30 from being chafed by the protection plate 200.

While certain embodiments have been described and exemplified above, various other embodiments will be apparent to those skilled in the art from the foregoing disclosure. The present invention is not limited to the particular embodiments described and exemplified, and the embodiments are capable of considerable variation and modification without departure from the scope of the appended claims.

What is claimed is:

1. A protection case for accommodating an electronic device, the electronic device comprising a display screen, the protection case comprising:

a soft encasing defining a receiving space for receiving the electronic device, and comprising a side wall; and a rigid protection plate attached to an inner surface of the side wall, the protection plate comprising a first surface facing the inner surface of the side wall and a second surface facing the receiving space of the soft encasing, the protection plate defining a recess on the second surface thereof corresponding to the display screen of the electronic device;

wherein, the soft encasing further comprising an interlayer covering the second surface of the protection plate.

2. The protection case for accommodating an electronic device of claim 1, wherein the soft encasing is made of leather, textile, or rubber.

3. The protection case for accommodating an electronic device of claim 1, wherein the protection plate is made of metal or plastic.

4. The protection case for accommodating an electronic device of claim 1, wherein the shape of the recess of the protection plate is substantially same to that of the display screen of the electronic device.

5. The protection case for accommodating an electronic device of claim 4, wherein the shape of the recess is rectangular.

6. The protection case for accommodating an electronic device of claim 1, wherein the size of the recess of the protection plate is equal to or larger than that of the display screen of the electronic device.

7. The protection case for accommodating an electronic device of claim 1, wherein the size of the recess of the protection plate is smaller than that of the electronic device.

8. The protection case for accommodating an electronic device as claimed in claim 1, wherein the interlayer is made of leather, textile, or rubber.

9. An electronic product comprising:

an electronic device comprising a display screen; and a protection case comprising:

a soft encasing defining a receiving space for receiving the electronic device, and comprising a side wall; and a rigid protection plate attached to an inner surface of the side wall, the protection plate comprising a first surface facing the inner surface of the side wall and a second surface facing the receiving space of the soft encasing, the protection plate defining a recess on the second surface thereof corresponding to the display screen of the electronic device;

wherein, the soft encasing further comprising an interlayer covering the second surface of the protection plate.

10. The electronic product of claim 9, wherein the electronic device is a mobile phone or a digital camera.

11. The electronic product of claim 9, wherein the soft encasing is made of leather, textile, or rubber.

12. The electronic product of claim 9, wherein the protection plate is made of metal or plastic.

13. The electronic product of claim 9, wherein the shape of the recess of the protection plate is substantially same to that of the display screen of the electronic device.

14. The electronic product of claim 13, wherein the shape of the recess is rectangular.

15. The electronic product of claim 9, wherein the size of the recess of the protection plate is equal to or larger than that of the display screen of the electronic device.

16. The electronic product of claim 9, wherein the size of the recess of the protection plate is smaller than that of the electronic device.

17. The electronic product as claimed in claim 9, wherein the interlayer is made of leather, textile, or rubber.

* * * * *